United States Patent [19]

Saito et al.

[11] Patent Number: 4,992,801

[45] Date of Patent: Feb. 12, 1991

[54] GLASS ANTENNA DEVICE FOR AN AUTOMOBILE

[75] Inventors: Toshihiko Saito, Ebina; Michio Ono, Yokohama; Hijiri Ichihara, Tokyo; Mitsuo Takabatake, Yokohama; Shinichi Watanabe, Yokohama; Kenji Oda, Yokohama; Masanobu Ogawa, Kanagawa, all of Japan

[73] Assignee: Asahi Glass Company Ltd., Tokyo, Japan

[21] Appl. No.: 383,525

[22] Filed: Jul. 24, 1989

[30] Foreign Application Priority Data

| | | | |
|---|---|---|---|
| Jul. 25, 1988 | [JP] | Japan | 63-185128 |
| Sep. 2, 1988 | [JP] | Japan | 63-220204 |
| Sep. 2, 1988 | [JP] | Japan | 63-115710[U] |

[51] Int. Cl.[5] ..... H01Q 1/32; H01Q 1/12

[52] U.S. Cl. ..... 343/713; 343/850

[58] Field of Search ..... 343/711–713, 343/850, 860

[56] References Cited

U.S. PATENT DOCUMENTS

| | | | |
|---|---|---|---|
| 3,599,214 | 8/1971 | Altmayer | 343/713 |
| 3,866,232 | 2/1975 | Weigt | 343/713 |

FOREIGN PATENT DOCUMENTS

| | | | |
|---|---|---|---|
| 960759 | 1/1975 | Canada | 343/713 |
| 2328167 | 12/1974 | Fed. Rep. of Germany | 343/713 |
| 2328168 | 12/1974 | Fed. Rep. of Germany | 343/713 |
| 2429628 | 1/1976 | Fed. Rep. of Germany | 345/713 |

*Primary Examiner*—Michael C. Wimer

*Attorney, Agent, or Firm*—Oblon, Spivak, McClelland, Maier & Neustadt

[57] ABSTRACT

A glass antenna device for an automobile comprises a glass plate fitted to an opening for a window, an antenna conductor having a power feeding point arranged on the glass plate and a matching circuit electrically connected to the power feeding point.

12 Claims, 4 Drawing Sheets

GLASS ANTENNA DEVICE FOR AN AUTOMOBILE

BACKGROUND OF THE INVENTION

The present invention relates to a glass antenna device for an automobile in which a feeder line drawing terminal is provided for connecting an antenna element in a glass antenna to a lead wire for a receiver feeder line.

It has been proposed to miniaturize a glass antenna system for an automobile by sealing an antenna line 70 of a metallic material in a laminated glass plate 71 and by attaching antenna peripheral circuit elements 72 and other components 73 at a cut portion 74 formed at a circumferential edge of the laminated glass plate 71 as in Japanese Examined Utility Model Publication No. 48681/1977 entitled "Antenna Window Glass" (refer prior art FIG. 14). However, the glass antenna as proposed has disadvantages as follows. When an antenna peripheral circuit element is directly installed in the rear window glass of an automobile, it is difficult to carry out soldering operations because the size of circuit elements is relatively small in comparison with the glass plate. It is difficult to attach the elements onto the rear window glass because a curved glass plate is generally used in consideration of the design of an automobile. When an antenna device is used for receiving radio waves having short wavelengths, the characteristic of the antenna device is influenced by accuracy in positioning of the circuit elements attached to the surface of the glass plate by soldering. It is difficult to obtain highly accurate dimensions, and scattering may result with respect to the performance of the antenna device. Further, it is not desirable to attach the circuit elements on the glass plate from the standpoint of appearance.

As a structure for connecting a power feeding line to a bus bar for an electric heating type defogger installed in the rear window of an automobile, it has been known to connect by soldering a connecting metal fitting having a high tensile strength to a power feeding part which is formed by printing silver paste in a predetermined pattern followed by baking it (refer to Japanese Examined Utility Model Publication 37182/1986 and Japanese Examined Utility Model Publication No. 11,745/1972).

SUMMARY OF THE INVENTION

It is an object of the present invention to provide a glass antenna device in which an antenna peripheral circuit module is connected to the antenna conductor at the location of the antenna conductor, and the electrical continuity of the antenna peripheral circuit module is maintained, regardless of damage to the connecting metal fitting on which the antenna peripheral circuit module is attached to the window glass plate.

According to the present invention, a glass antenna device comprises an antenna conductor formed to a vehicle window plate, the antenna conductor defining a power feeding point, a connecting metal fitting having at least two legs, a raised portion intermediate the legs and an output terminal is connected via the legs to the glass plate for attaching the connecting metal fitting to the glass plate. An antenna peripheral circuit module is mechanically mounted to the connecting metal fitting and electrically connected to the output terminal. The circuit module is also connected to the power feeding point via an electrical connection independent of at least one of the legs, so that damage to a connection of the at least one of the legs to the glass plate will not affect an electrical continuity of the circuit module.

In the present invention, an end, ends or a predetermined portion of an antenna conductor which is or are formed by arranging a strip or strips in a predetermined pattern on or in a glass plate of an automobile is or are used as a power feeding point or points for connecting an antenna cable, and if desirable, a connecting metal fitting or fittings susceptible to solder is or are attached to the power feeding point or the points, Then, the antenna peripheral circuit module is connected to the power feeding point. Preferably, it is connected to the power feeding point by using the connecting metal fitting by a suitable method such as soldering. In order to fix the antenna peripheral circuit module onto the glass plate in a stable manner, the antenna peripheral circuit module can be supported by using the connecting metal fitting having a pair of legs bonded to the glass plate. In this case, the legs of the connecting metal fitting are respectively connected by soldering to one or two power feeding points. The power feeding point may be constituted by a main terminal and a dummy terminal wherein the main terminal is used as a terminal portion to be connected to a receiver.

In accordance with the glass antenna device for an automobile of the present invention, the antenna peripheral circuit such as the matching circuit module is attached on the glass plate at a position near the antenna conductor. Accordingly, the length of a line of connection is electrically short and the circuit has a wiring arranged in a pattern, whereby the stray capacitance of the line can be constant.

The antenna conductor is connected by soldering to the antenna peripheral circuit module in one piece. Accordingly, adjustment of the glass antenna device in an electrical sense can be made uniform.

A packaged top loading circuit module may be connected to an end other than the power feeding point of the antenna conductor on the glass plate.

The present invention is intended to provide a glass antenna device for an automobile which comprises an antenna glass system in which an antenna conductor and a power feeding point for the antenna conductor are arranged on or in a glass plate to be fitted to a window of the automobile; a connecting metal fitting connected to the power feeding point of the antenna conductor and an antenna peripheral circuit module is electrically connected to and is formed integrally with the terminal of metal.

The present invention is to provide a glass antenna device for an automobile which comprises an antenna glass system in which an antenna conductor and a power feeding point for the antenna conductor are arranged on or in a glass plate to be fitted to a window of the automobile, a connecting metal fitting connected to the power feeding point of the antenna conductor, and an antenna peripheral circuit module comprising a multi-layered ceramic base plate in which at least one resistor is formed in a film having a predetermined pattern on a surface layer of the multi-layered ceramic base plate; one or more number of coils and capacitors are formed in a film having a predetermined pattern on an inner layer of the base plate, and electronic components such as a semiconductor, or another resistor, coil and capacitor having a large capacity or to be prepared according to special requirements, electrically connected to the surface layer of the base plate.

In the antenna device as described above, the antenna conductor is formed by a strip or strips arranged in a glass plate for a window of the automobile in a predetermined pattern, and a power feeding point is connected to an end, each end or a predetermined portion of the antenna conductor to take radio wave signals received by the antenna conductor. The connecting metal fitting is connected to the power feeding point and an antenna peripheral circuit module.

As the antenna peripheral circuit used for the present invention, various types of circuit such as a matching circuit for matching the impedance between the antenna conductor and the receiver, a pre-amplifying circuit for amplifying a radio wave signal received by the antenna conductor, a reactance circuit or a loading circuit may be employed depending on a purpose of use.

As the base plate on which the above mentioned antenna peripheral circuit is packaged, a resin type or a ceramic type multi-layered base plate may be used. In particular, a ceramic multi-layered base plate baked at a low temperature is suitably used for the purpose of the present invention. The ceramic multi-layered base plate can contain elements which function as a coil and a capacitor. An element which functions as a resistor can be formed on a surface layer of the base plate. Accordingly, the antenna peripheral circuit having a compact size and connectable to a connection terminal can be obtained. Further, durability and reliability can be obtained.

In the construction of the antenna peripheral circuit using the ceramic multi-layered base plate, a resistor is formed in a film having a predetermined pattern on the surface layer of the multi-layered ceramic base plate. A coil and a capacitor are formed in a film having a predetermined pattern on an inner layer of the base plate. An electronic component such as a semiconductor or an electric element such as a resistor, a coil and/or a capacitor having a large capacity or to be prepared according to special requirements are attached to predetermined positions of a surface layer of the ceramic multi-layered base plate by means of a suitable bonding method such as soldering.

The connecting metal fitting connected to the power feeding point of the antenna conductor is required to have a large tensile strength. Accordingly, it should have such construction that a tensile force is directly exerted to the surface of the glass plate for a window of the automobile when a stress is applied to the connecting metal fitting. The base plate of the antenna peripheral circuit should be positioned at a suitable location such as the upper portion, the lower portion, a side portion or the central portion of the terminal to which the tensile stress does not applied. It is desirable that the terminal and the power feeding point of the antenna conductor are close to and connected to each other in order to improve an S/N ratio.

In the present invention, the antenna conductor having a predetermined pattern on or in the glass plate of the automobile is adapted to receive radio waves so that the radio waves are supplied from the power feeding point to the antenna peripheral circuit. The circuit is electrically connected to the terminal which is, in turn, connected to a signal receiving unit such as a radio, a television, a telephone and so on via a connector and a cable.

Thus, even when an external force is applied to the connecting metal fitting, there is no influence to the function of the antenna peripheral circuit, and the external force is applied only to the glass plate. Therefore, the damage of the antenna peripheral circuit can be minimized.

The present invention is intended to provide, glass antenna device for an automobile characterized in that the connecting metal fitting has legs at both sides, a raised portion formed by bending upwardly the intermediate portion between the legs, and a shank portion extending laterally or upwardly from the raised portion; and a ceramic base plate is attached to the back surface of the raised portion so as to connect them electrically, wherein the ceramic base plate is provided, at its other surface opposite the surface attached to the back surface of the raised portion, with a reactance circuit and a terminal piece to be connected to the power feeding point of the antenna conductor, which projects from an opening or a recess formed in one of the side wall portions, and the surrounded portion is filled with a resinous material by molding.

The connecting metal fitting is provided with the terminal piece to be connected to the antenna conductor, which is electrically connected to a predetermined portion of the ceramics base plate. The reactance circuit functioning as the antenna peripheral circuit which is constituted by one or more number of coils, resistors and capacitors is attached to the ceramics base plate which is, in turn, provided with a signal terminal different from the terminal piece on the opposite surface, and the signal terminal is electrically connected to the connecting metal fitting. The connecting metal fitting has the shank portion which has such a shape that it is electrically and mechanically connectable to an external antenna feeder. The connecting metal fitting has two legs to be connected to the feeding point of the glass plate. The legs are connected by soldering to an electrode (i.e. the power feeding point) which is formed by baking an electric conductive material such as silver paste arranged on the glass plate in a predetermined pattern. The connecting metal fitting is electrically connected the ceramic base plate, the reactance circuit as the antenna peripheral circuit and the terminal piece by soldering or with use of an adhesive, and it secures in one piece by silicone resin or epoxy resin.

As shown in FIG. 9, a terminal device 60 connectable to an antenna feeder line is connected by means of soldering, brazing or an adhesive of electrically conductive material to a power feeding portion 44 of an antenna conductor 42 of glass antenna system in which the antenna conductor 42 is formed on a glass plate 41 to thereby form a glass antenna device for an automobile. The reactance circuit can be placed adjacent the antenna element by including the reactance circuit in the terminal of metal.

DESCRIPTION OF THE PREFERRED EMBODIMENTS

Figure 1:
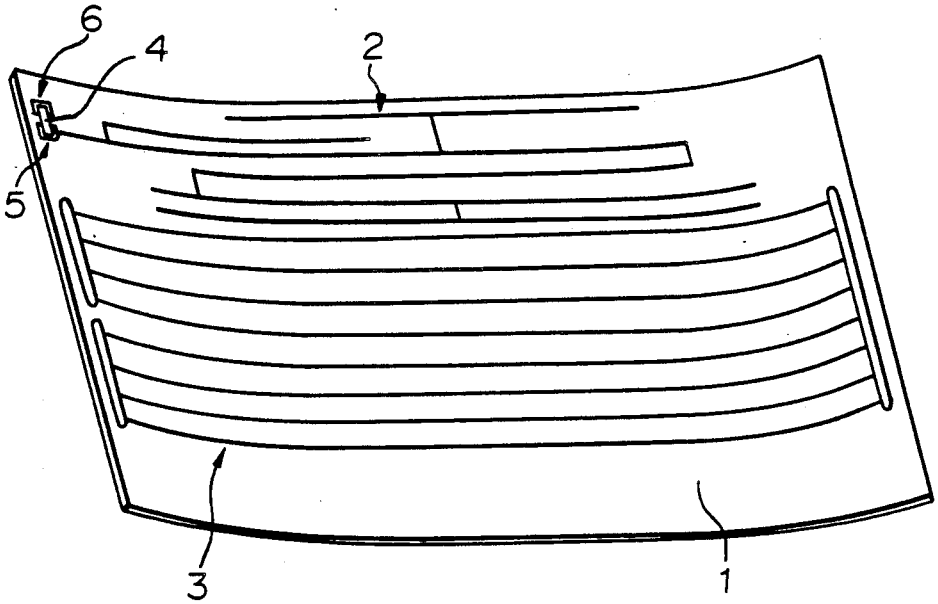
FIG. 1 is a front view of an embodiment of the glass antenna device according to the present invention.

Referring to the drawings, preferred Examples of the glass antenna device of the present invention will be described referring to the drawings.

EXAMPLE 1

In FIG. 1, a reference numeral 1 designates a glass plate for the rear window of an automobile. An antenna conductor 2 is formed on the surface of the glass plate 1 to have a predetermined pattern by strips of conductive material. A terminal device 12 with a matching circuit module 4 as an antenna peripheral circuit is formed in the vicinity of the end of the antenna conductor 2. The terminal device 12 is connected to a power feeding point 5 at an end of the antenna conductor 2. A dummy terminal 6 on the glass plate 1 functions to merely fix the terminal device 12 and it has no wire connection to a power feeding point on the glass plate 1.

Figure 2:
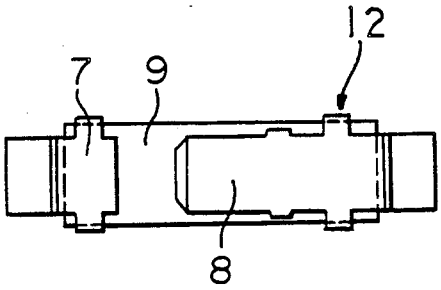
FIG. 2 is a front view showing an embodiment of the fitting part of an antenna peripheral circuit as shown in FIG. 1.
Figure 3:
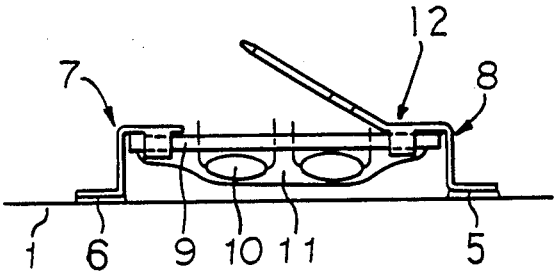
FIG. 3 is a side view of the fitting part shown in FIG. 2.

FIGS. 2 and 3 show the terminal device 12 with the matching circuit module 4 as an antenna peripheral circuit module in more detail. The matching circuit module 4 comprises a base plate 9 made of a resinous material or ceramics, one or more of electric elements 10 such as resistors, capacitors and coils and at least one electronic element such as a semiconductor, all cooperating to form a matching circuit attached onto the base plate 9. Metal fitting legs 7, 8 are connected to the base plate 9. The metal fitting leg 8 is connected to the power feeding point of the antenna conductor 2 on the glass plate 1, and the metal fitting leg 7 is connected to the dummy terminal 6 on the glass plate, 1. The metal fitting leg 8 has a shank portion which serves as a connector to a receiver so as to transmit a signal.

The base plate 9 on which the electric and electronic elements 10 are formed or mounted is covered with a resin coat 11 to thereby increase reliability.

Thus, by fitting the matching circuit module at the power feeding point on the glass plate 1, the length of line from the antenna conductor to the circuit module can be reduced to thereby interrupt undesired external noises and reduce stray capacitance due to the connection line. The antenna conductor is formed by using a screen printing method. Accordingly, good reproducibility is obtainable in manufacturing steps, and a stable antenna system is obtainable. The size of the overall antenna system, and further the manufacturing cost can be reduced.

The terminal device with the matching circuit module can be assembled at the separate place from a place where the glass plate is produced. Accordingly, the manufacturing and the maintenance of the terminal device, the module and glass plate can be easy.

When an external pressure by, for instance, a cable is applied to the terminal device, it is transmitted directly from the metal fitting leg 8 to the surface of the glass plate 1 so that the matching circuit module can be protected. Even though if the metal fitting leg 7 is broken, only the dummy terminal 6 is broken and there is no danger of the breaking of the glass plate 1 and the base plate 9.

EXAMPLE 2

Another embodiment of the glass antenna device of the present invention in which a matching circuit is used for the antenna peripheral circuit will be described.

Figure 4:
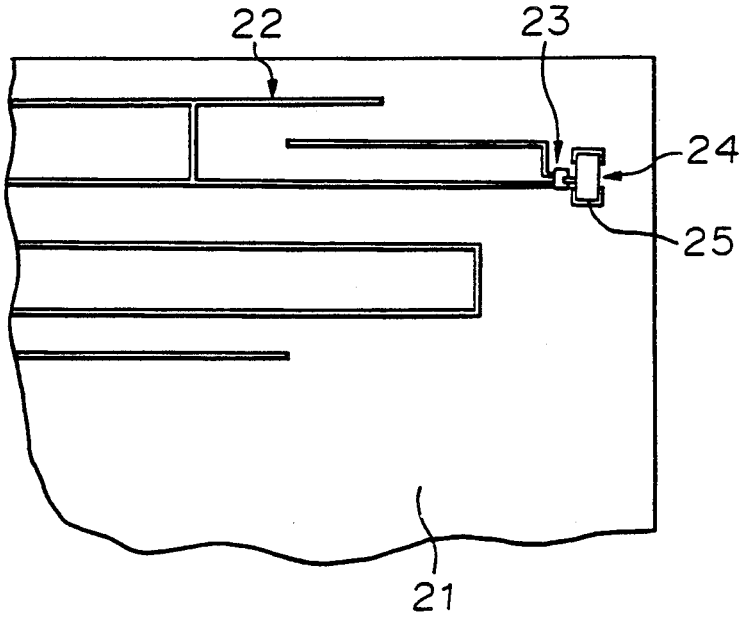
FIG. 4 is an enlarged front view of the glass antenna device showing an antenna peripheral circuit module.
Figure 5:
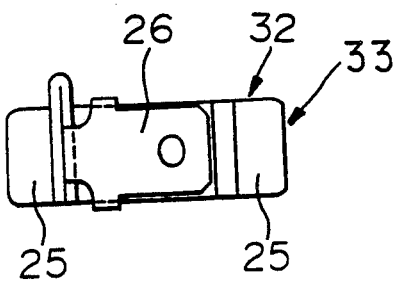
FIG. 5 is an enlarged front view of an embodiment of the base plate of the antenna peripheral circuit module shown in FIG. 1.
Figure 6:
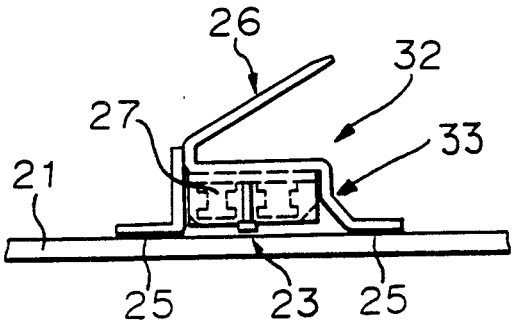
FIG. 6 is a side view of the base plate shown in FIG. 5.

In FIG. 4, an antenna conductor 22 is formed by arranging strips of electric conductive material in a predetermined pattern on the surface facing the cabin of the glass plate 21 to be fitted to the rear window opening of an automobile. A radio wave signal received by the antenna conductor 22 is transmitted from a power feeding point 23 to a matching circuit module 24. The matching circuit module 24 is attached onto the glass plate 21 by connecting the connecting metal fitting 32 by soldering. As shown in FIG. 6, the power feeding point 23 is connected to the electrode of the matching circuit module 27 by soldering independent of the legs 25 of the metal fitting 32.

In this Example, a terminal piece or connecting element 26 of a connecting metal fitting 32 is used as an output terminal for the matching circuit module 24 as shown in FIG. 6. By inserting a connector to the connecting element 26, the signal can be led to the outside. The connector is to supply a radio wave signal to a signal receiving unit through a coaxial cable.

In FIG. 6, the terminal device 33 is so constructed that a base plate 27 for the matching circuit module 24 is connected to the connecting metal fitting 32 by soldering or a suitable method, which functions as an electrode for the base plate 27 as well as a fitting means. The connecting metal fitting 32 is connected integrally with the base plate 27 by soldering or another suitable method. Further, the base plate 27 is sealingly surrounded by a resin mold so as to increase reliability.

Figure 7:
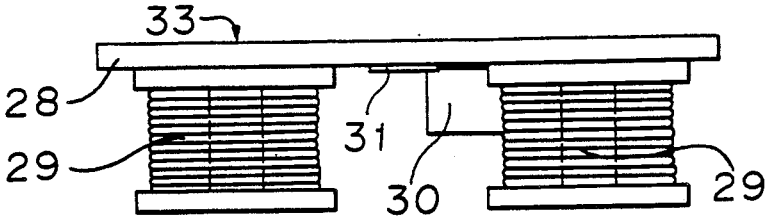
FIG. 7 is an enlarged view showing the base plate as in FIG. 6.
Figure 8:
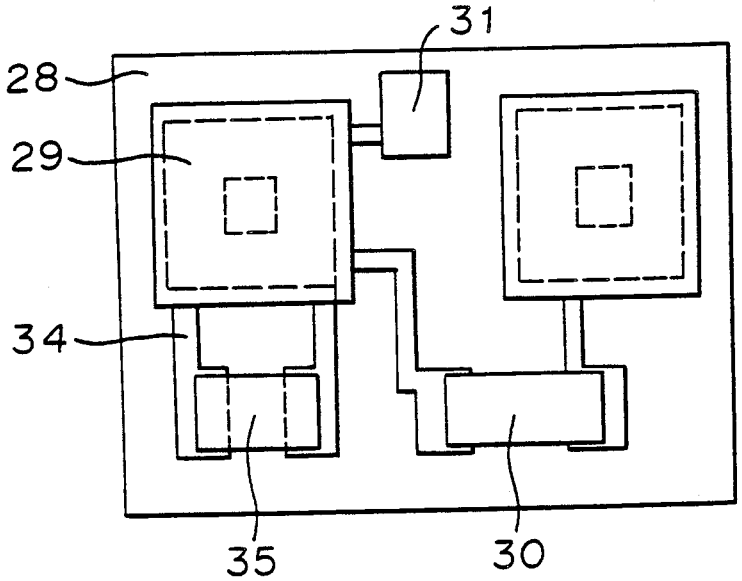
FIG. 8 is a front view of the base plate shown in FIG. 7.

FIG. 7 is an enlarged side view of the base plate 27 and FIG. 8 is an enlarged front view of the base plate, wherein a coil 29 and a capacitor 30 are respectively elements of a surface fitting type, and they are attached onto a ceramic base plate 28. A resistor 35 is formed by a printing method. The ceramic base plate 28 has a multi-layered structure in which a number of films having predetermined patterns including coils and capacitors are laminated. In FIGS. 7 and 8, a numeral 34 designates a line connecting structural elements, which are arranged in a pattern, a numeral 31 is an electrode as an input part for signal frOm the antenna conductor, which is connected with a terminal of metal by soldering, and a numeral 33 designates an output part for outputting a signal which is supplied to the signal receiving unit.

The antenna peripheral circuit module shown in FIGS. 7 and 8 can be extremely compact. Further, durability with respect to an external force of the module is the same level as that of the conventional device since the antenna peripheral circuit is attached to the back surface side of the connecting metal fitting A desired S/N ratio is obtainable because the antenna peripheral circuit module is placed in the vicinity of the power feeding point of the antenna conductor. When the glass antenna device is used for receiving radio waves having a short wavelength, accuracy in dimensions depends on the arrangement of the structural elements on the ceramic base plate. Accordingly, scattering of the performance of antenna can be minimized by paying attention to the accurate arrangement of the elements when the circuit module is assembled.

The antenna peripheral circuit module can eliminate the disadvantages that it is difficult to directly attach the structural elements of the antenna device on a curved glass plate to be fitted to a window of an automobile and it is difficult to attach them by soldering because the structural elements are relatively small in comparison with the size of the glass plate.

EXAMPLE 3

Figure 9:
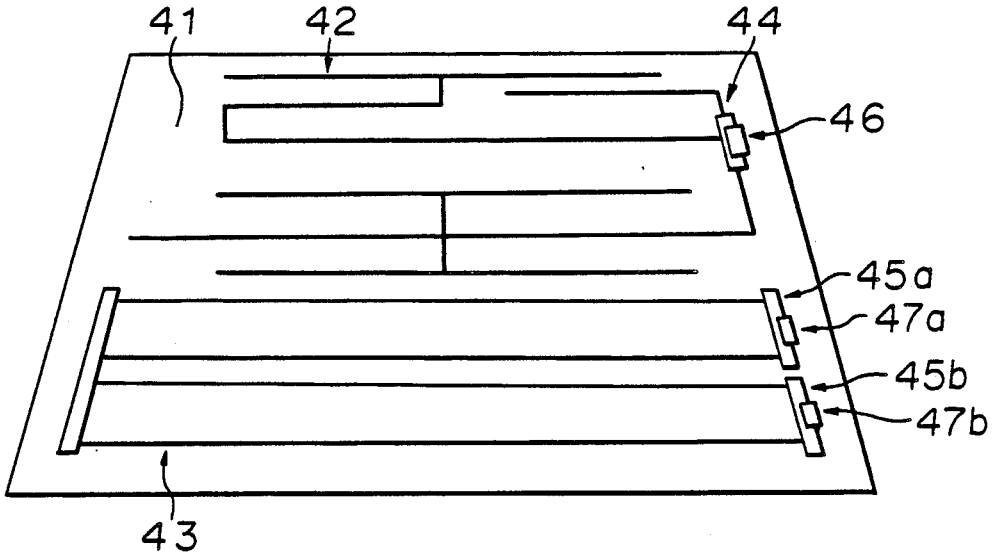
FIG. 9 is a front view of another embodiment of the glass antenna device according to the present invention.

FIG. 9 is a front view showing another embodiment of the glass antenna device formed in a glass plate to be fitted to the rear window opening of an automobile. An antenna conductor 42 is arranged at the upper portion of the glass plate 41. A number of electric heating elements are arranged in the center portion of the glass plate to form a defogger. Terminals 47 (47*a*, 47*b*) for power feeding parts 45*a*, 45*b* which supply a current to the electric heating type elements of the defogger may be conventionally used terminals.

Figure 10:
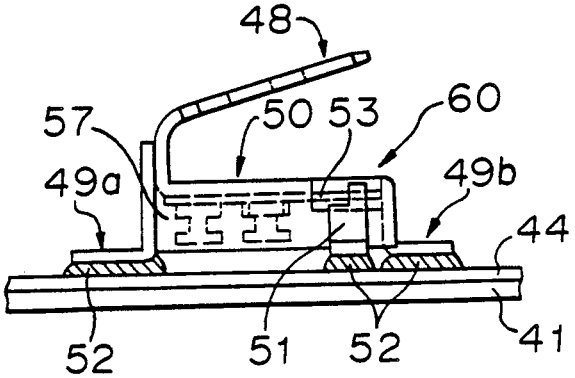
FIG. 10 is a side view partly cross-sectioned of an embodiment of the terminal device according to the present invention.

FIG. 10 is a side view showing a terminal of metal 46 of a terminal device 60 for the antenna conductor. In FIG. 10, the connecting metal fitting 46 is provided with legs 49, (49*a*, 49*b*) at both side portions. The legs are fixed onto the glass plates 41 by soldering at a power feeding part 44 which is formed by baking a printed pattern of silver paste formed at a predetermined portion of the glass plate 41.

Figure 11:
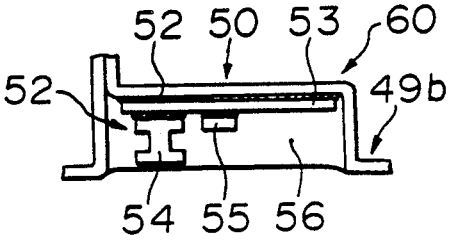
FIG. 11 is a cross-sectional view of a ceramic base plate as shown in FIG. 10.

The terminal of metal 46 further has a raised portion 50 which is formed at the intermediate portion between the legs 49*a*, 49*b* and a pair of side wall portions 57 extending downwardly from the two other sides of the raised portion so that a surrounded portion with an open bottom is formed. As shown in FIG. 11 of a cross-sectional view showing the inside of the surrounded portion, a ceramic base plate 53 is placed in the surrounded portion so that the circuit module is electrically shielded. On the ceramic base plate 53, a coil 54 and a capacitor 53 are electrically and mechanically connected by a solder layer 52. The opposite surface of the ceramic base plate 53 is attached to the back surface of the raised portion 50 by another solder layer 52. The inside of the surrounded portion is entirely or partially filled with a resinous material 56 for sealing such as silicon resin by molding to cover the ceramic base plate 53 as well as the electric and electronic elements. A terminal piece 51 to be connected to the antenna conductor is connected to a connecting terminal of the ceramic base plate 53. A shank portion 48 to be connected to the feeder line is formed integrally with the connecting metal fitting 46. The shank portion 48 is extended upwardly or laterally from the raised portion 50 of the connecting metal fitting 46.

Figure 12:
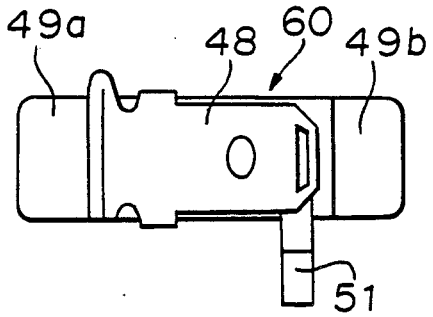
FIGS. 12 and 13 are front views of another embodiment of the terminal device according to the present invention.
Figure 13:
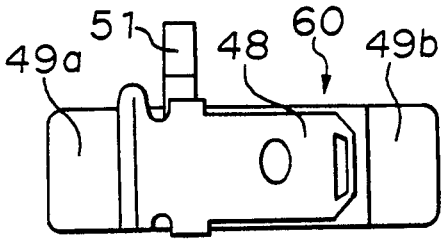
Figure 14:
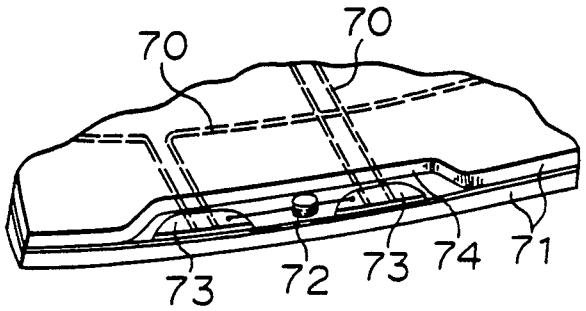
FIGURE 14 PRIOR ART
FIG. 14 is a perspective view partly broken of a conventional glass antenna device.

As shown in FIG. 12, the terminal piece 51 connectable to the power feeding point of the antenna conductor is adapted to be connected to a power feeding portion 44 in the same manner that the legs 49*a*, 49*b* are. However, it is possible to change the position of the terminal piece 51 as shown in FIG. 13. The terminal piece 51 to be connected to the power feeding part of the antenna conductor may be so formed that it projects through an opening or a recess formed in one of the side wall portions of the connecting metal fitting 46.

In this Example, the connecting metal fitting is attached to the surface of the glass plate at the power feeding part by soldering with a sufficient strength to a force pulling the terminal upwardly. The strength of attaching the connecting metal fitting to the glass plate is the same as that of the conventional terminal for a defogger attached to the rear window glass of an automobile.

Thus, by unifying the connecting metal fitting, the antenna peripheral circuit, the terminal piece and the ceramic base plate, a compact terminal device with an antenna peripheral circuit module is obtainable and an excellent design can be provided for the glass antenna device. Since the antenna elements and the antenna peripheral circuit are electrically adjacent to each other, a noiseless antenna device can be prepared. Further, the difficulty of attaching the structural elements having a small size in comparison with the size of the plate can be eliminated by constituting the structural elements in a unit. In addition, use of the antenna peripheral circuit module reduces the manufacturing cost.

We claim:

1. A glass antenna device comprising:

an antenna conductor formed to a vehicle window glass plate, said antenna conductor defining a power feeding point;

a connecting metal fitting having at least two legs, a raised portion intermediate said legs and an output terminal, wherein said legs are connected to said glass plate for attaching said connecting metal fitting to said glass plate; and an antenna peripheral circuit module mechanically mounted to said connecting metal fitting and electrically connected to said output terminal, wherein said circuit module is also connected to said power feeding point via an electrical connection independent of at least one of said legs, whereby damage to the connection of said at least one of said legs to said glass plate will not affect an electrical continuity of said circuit module.

2. The glass antenna device for an automobile according to claim 1, wherein said antenna peripheral circuit module comprises a plurality of resistors, capacitors and coils and at least one electronic device for constituting an antenna peripheral circuit, which are attached onto a base plate of a resinous material and which are covered by molding a resinous material, and said antenna peripheral circuit module is connected by soldering to said power feeding point of the antenna conductor formed to said glass plate.

3. The glass antenna device for an automobile according to claim 1, wherein said antenna peripheral circuit module comprises a plurality of resistors, capacitors and coils and at least one electronic device for constituting an antenna peripheral circuit, which are attached onto a base plate of ceramics and which are covered by molding a resinous material, and said antenna peripheral circuit module is connected by soldering to said power feeding point of the antenna conductor formed to said glass plate.

4. The glass antenna device for an automobile according to claim 1, wherein said antenna peripheral circuit module comprises a plurality of resistors, capacitors and coils and at least one electronic device for constituting an antenna peripheral circuit, which are received in a ceramic package in a sealed condition, and said antenna peripheral circuit module is connected by soldering to said power feeding point of the antenna conductor formed to said glass plate.

5. The glass antenna device for an automobile according to claim 1, wherein said antenna peripheral circuit module comprises a multilayered ceramic base plate in which at least one resistor is formed in a film having a predetermined pattern on a surface layer of said multilayered ceramic base plate; a plurality of coils and capacitors are formed in a film having a predetermined pattern on an inner layer of said base plate, and electronic components are electrically connected to the surface layer of said base plate.

6. The glass antenna device for an automobile according to claim 1, wherein said antenna peripheral circuit module is a matching circuit for matching the impedance between the antenna conductor and a receiver.

7. The glass antenna device for an automobile according to claim 1, wherein said antenna peripheral circuit module is a pre-amplifier for amplifying radio wave signals received by the antenna conductor.

8. The device of claim 1 wherein said connecting metal fitting has two legs, one of said legs being fixed to said power feeding point and another of said two legs being fixed to a dummy terminal.

9. The device of claim 1 wherein said connecting metal fitting has two legs, and said power feeding point is independent of said two legs.

10. The device of claim 8 wherein said circuit module includes a base plate having ends connected to respective ones of said legs.

11. The device of claim 1 including molded resin enclosing said module.

12. The device of claim 9 wherein said raised portion of said connecting metal fitting has side wall portions extending downwardly toward the glass plate to form a surrounded portion, and wherein said circuit module is mounted in said surrounded portion and is electrically shielded thereby.

* * * * *